US006039430A

United States Patent [19]

Helterline et al.

[11] Patent Number: 6,039,430

[45] Date of Patent: Mar. 21, 2000

[54] METHOD AND APPARATUS FOR STORING AND RETRIEVING INFORMATION ON A REPLACEABLE PRINTING COMPONENT

[75] Inventors: Brian L. Helterline, Salem, Oreg.; Michael L. Bullock; Winthrop D. Childers, both of San Diego, Calif.

[73] Assignee: Hewlett-Packard Company, Palo Alto, Calif.

[21] Appl. No.: 09/148,039

[22] Filed: Sep. 3, 1998

Related U.S. Application Data

[63] Continuation-in-part of application No. 09/092,111, Jun. 5, 1998.

[51] Int. Cl.[7] ..... B41J 29/393

[52] U.S. Cl. ..... 347/19; 347/7; 400/208

[58] Field of Search ..... 347/7, 14, 17, 347/19; 400/207, 208, 208 E

[56] References Cited

U.S. PATENT DOCUMENTS

| | | | |
|---|---|---|---|
| 4,551,000 | 11/1985 | Kanemitsu | 355/3 R |
| 4,803,521 | 2/1989 | Honda | 355/14 R |
| 4,961,088 | 10/1990 | Gilliland et al. | 355/206 |
| 5,021,828 | 6/1991 | Yamaguchi et al. | 355/209 |
| 5,137,379 | 8/1992 | Ukai et al. | 400/121 |
| 5,138,344 | 8/1992 | Ujita | 346/140 R |
| 5,184,181 | 2/1993 | Kurando et al. | 355/260 |
| 5,272,503 | 12/1993 | Le Sueur et al. | 355/208 |
| 5,410,641 | 4/1995 | Wakabayashi et al. | 395/112 |
| 5,610,634 | 3/1997 | Murata et al. | 347/5 |
| 5,646,660 | 7/1997 | Murray | 347/59 |
| 5,699,091 | 12/1997 | Bullock et al. | 347/19 |
| 5,788,388 | 8/1998 | Cowger et al. | 400/703 |
| 5,861,897 | 1/1999 | Ide et al. | 347/19 |

*Primary Examiner*—John S. Hilten
*Assistant Examiner*—Dave A. Ghatt
*Attorney, Agent, or Firm*—Kevin B. Sullivan

[57] ABSTRACT

An ink jet printing system including a replaceable printing component for use in the printing system. The replaceable printing component includes a memory portion associated therewith for storing information that does not relate directly to normal operation of the printing system. Also included is a control portion for providing information to the memory portion associated with the replaceable printing component.

22 Claims, 4 Drawing Sheets

METHOD AND APPARATUS FOR STORING AND RETRIEVING INFORMATION ON A REPLACEABLE PRINTING COMPONENT

CROSS REFERENCE TO RELATED APPLICATIONS

The present invention is a continuation-in-part of U.S. patent application Ser. No. 09/092,111 entitled "Apparatus Controlled by Consumable Parts with Incorporated Memory Devices" filed on Jun. 5, 1998 that is a continuation of U.S. Pat. No. 5,812,156 entitled "Apparatus Controlled by Consumable Parts with Incorporated Memory Devices" issued on Sep. 22, 1998 both of which are assigned to the assignee of the present invention and incorporated herein by reference.

BACKGROUND OF THE INVENTION

The present invention relates to ink jet printing systems that make use of a replaceable printing component. More particularly, the present invention relates to replaceable printing components that include an electrical storage device for providing information to the ink jet printing system.

Ink jet printers frequently make use of an ink jet printhead mounted within a carriage that is moved back and forth across a print media, such as paper. In operation of the printing system the printhead is moved across the print media, a control system activates the printhead to deposit or eject ink droplets onto the print media to form images and text. Ink is provided to the printhead by a supply of ink which is either carried by the carriage or mounted to the printing system to not move with the carriage. For the case where the ink supply is not carried with the carriage, the ink supply can be intermittently or continuously connected to the printhead for replenishing the printhead. In either case, the replaceable printing components, such as the ink container and the printhead, require periodic replacement. The ink supply is replaced when exhausted. The printhead is replaced at the end of printhead life.

It is frequently desirable to alter printer parameters concurrently with the replacement of printer components such as discussed in U.S. patent application Ser. No. 08/584,499, now U.S. Pat. No. 5,699,091 entitled "Replaceable Part With Integral Memory For Usage, Calibration And Other Data" assigned to the assignee of the present invention. U.S. Pat. No. 5,699,091 discloses the use of a memory device, which contains parameters relating to the replaceable part. The installation of the replaceable part allows the printer to access the replaceable part parameters to insure high print quality. By incorporating the memory device into the replaceable part and storing replaceable part parameters in the memory device within the replaceable component the printing system can determine these parameters upon installation into the printing system. This automatic updating of printer parameters frees the user from having to update printer parameters each time a replaceable component is newly installed. The printer uses these parameters to control the operation of the printer to ensure high print quality.

The use of parameters stored on the replaceable consumable can be used to control a wide variety of printing system operations. These printing system operations include optimizing print quality and preventing inadvertent damage to the printer resulting from improper operation, such as, operating after the supply of ink is exhausted or operation with the wrong or non-compatible printer components.

SUMMARY OF THE INVENTION

The present invention is an ink jet printing system that includes a replaceable printing component for use in the printing system. The replaceable printing component includes a memory portion associated therewith for storing information that does not relate directly to normal operation of the printing system. Also included is a control portion for providing information to the memory portion associated with the replaceable printing component.

In one preferred embodiment the replaceable printing component contains marketing related information that is stored by the control portion. In yet another preferred embodiment the replaceable printing component contains maintenance-related information that is stored by the control portion.

Another aspect of the present invention is a method for collecting data from an ink jet printing system. The method includes transferring information from the printing system to a memory portion associated with a replaceable printing component. Also included is the step of removing the replaceable printing component from the printing system and reading information in the memory portion transferred from the printing system.

DETAILED DESCRIPTION OF THE PREFERRED EMBODIMENT

Figure 1:
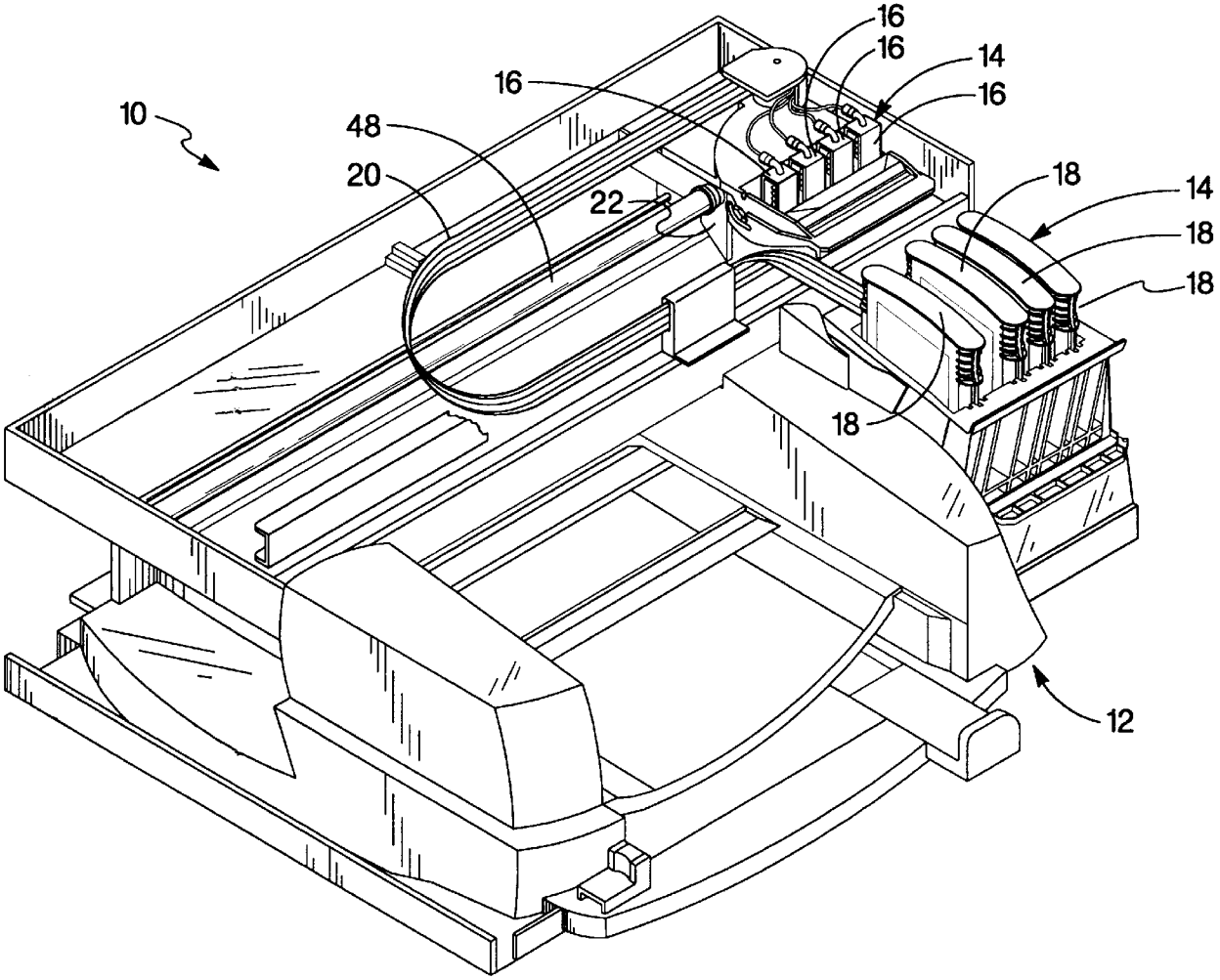
FIG. 1 depicts a perspective view of an exemplary ink jet printing system, shown with the cover removed, that incorporates removable printing components of the present invention.

FIG. 1 is a perspective view of one exemplary embodiment of an ink jet printing system 10 of the present invention shown with its cover removed. The ink jet printing system 10 includes a printer portion 12 having a plurality of replaceable printing components 14 installed therein. The plurality of replaceable printing components 14 include a plurality of printheads 16 for selectively depositing ink in response to control signals and a plurality of ink containers 18 for providing ink to each of the plurality of printheads 16. Each of the plurality of printheads 16 is fluidically connected to each of the plurality of ink containers 18 by a plurality of flexible conduits 20.

Each of the plurality of printheads 16 is mounted in a scanning carriage 22, which is scanned past a print media (not shown) as the print media is stepped through a print zone. As the plurality of printheads are moved relative to the print media, ink is selectively ejected from a plurality of orifices in each of the plurality of printheads 16 to form images and text.

One aspect of the present invention is a method and apparatus for storing and retrieving information on the replaceable printing components 14 for updating parameters that do not relate to normal operation of the printer portion 12. These parameters will be discussed in more detail with respect to FIG. 5 after a more detailed discussion of the printer portion 12 operation. An electrical storage device is associated with each of the replaceable printing components 14. The electrical storage device contains information related to the particular replaceable printer component 14. Installation of the replaceable printing component 14 into the printer portion 12 allows information to be transferred between the electrical storage device and the printing portion 12 to insure high print quality as well as to prevent the installation of non-compatible replaceable printing components 14. The information provided from the replaceable printing component 14 to the printing portion 12 tends to prevent operation of the printing system 10 in a manner which damages the printing system 10 or which reduces the print quality.

Although the printing system 10 shown in FIG. 1 makes use of ink containers 18 which are mounted off of the scanning carriage 22, the present invention is equally well suited for other types of printing system configurations. One such configuration is one where the replaceable ink containers 18 are mounted on the scanning carriage 22. Alternatively, the printhead 16 and the ink container 18 may be incorporated into an integrated printing cartridge that is mounted to the scanning carriage 22. Finally, the printing system 10 may be used in a wide variety of applications such as facsimile machines, postal franking machines and large format type printing systems suitable for use in displays and outdoor signage.

Figures 2A, 2B:
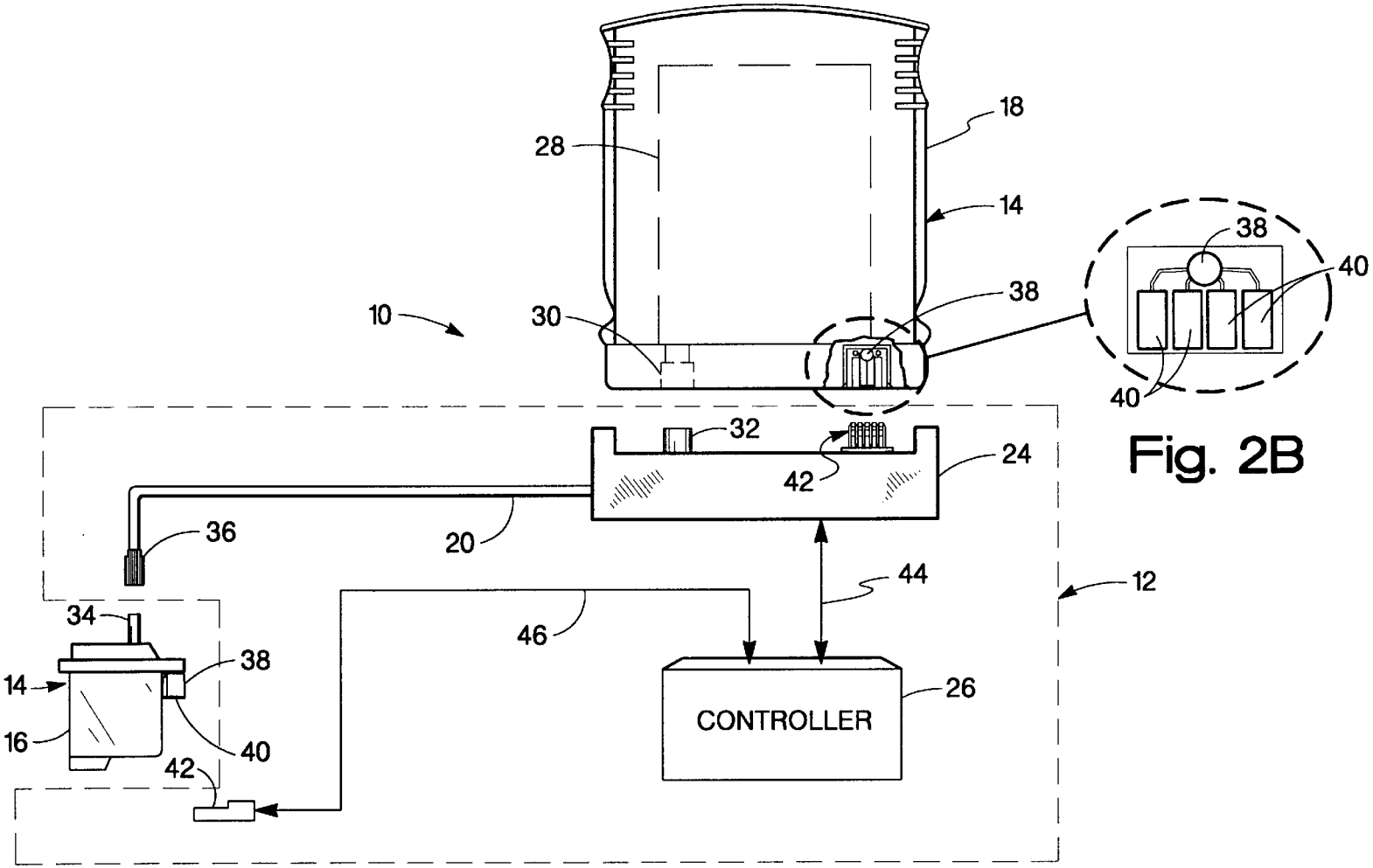
FIG. 2A depicts a schematic representation of the ink jet printing system shown in FIG. 1 illustrating a removable ink container and printhead each of which contain an electrical storage device.
FIG. 2B depicts a greatly enlarged view of the electrical storage device shown in FIG. 2A.

FIGS. 2A and 2B depict a simplified schematic representation of the ink jet printing system 10 of the present invention shown in FIG. 1. FIGS. 2A and 2B are simplified to illustrate a single printhead 16 and a single ink container 18 for accomplishing the printing of a single color. For the case where more than one color is desired a plurality of printheads 16 are typically used each having an associated ink container 18 as shown in FIG. 1.

The ink jet printing system 10 of the present invention includes a printer portion 12 having replaceable printing components 14. The replaceable printing components 14 include a printhead 16 and an ink container 18. The printer portion 12 includes an ink container receiving station 24 and a controller 26. With the ink container 18 properly inserted into the ink container receiving station 24, an electrical and a fluidic coupling is established between the ink container 18 and the printer portion 12. The fluidic coupling allows ink stored within the ink container 18 to be provided to the printhead 16. The electrical coupling allows information to be passed between the ink container 18 and the printer portion 12 to ensure the operation of the printer portion 12 is compatible with the ink contained in the ink container 18 thereby achieving high print quality and reliable operation of the printing system 10.

The controller 26 controls the transfer of information between the printer portion 12 and the ink container 18. In addition, the controller 26 controls the transfer of information between the printhead 16 and the controller 26. Finally, the controller 26 controls the relative movement of the printhead 16 and the print media as well as selectively activating the printhead to deposit ink on print media.

The ink container 18 includes a reservoir 28 for storing ink therein. A fluid outlet 30 is provided that it is in fluid communication with the fluid reservoir 28. The fluid outlet 30 is configured for connection to a complimentary fluid inlet 32 associated with the ink container receiving station 24.

The printhead 16 includes a fluid inlet 34 configured for connection to a complimentary fluid outlet 36 associated with the printing portion 12. With the printhead 16 properly inserted into the scanning carriage 22 (shown in FIG. 1) fluid communication is established between the printhead and the ink container 18 by way of the flexible fluid conduit 20.

Each of the replaceable printing components 14 such as the printhead 16 and the ink container 18 include an information storage device 38 such as an electrical storage device or memory 38 for storing information related to the respective replaceable printer component 14. A plurality of electrical contacts or linking portions 40 are provided, each of which is electrically connected to the electrical storage device 38. With the ink container 18 properly inserted into the ink container receiving station 24, each of the plurality of electrical contacts 40 engage a corresponding plurality of electrical contacts 42 associated with the ink container receiving station 24. Each of the plurality of electrical contacts 42 associated with the ink container receiving station 24 are electrically connected to the controller 26 by a plurality of electrical conductors 44. With proper insertion of the ink container 18 into the ink container receiving station 24, the memory 38 associated with the ink container 18 is electrically connected to the controller 26 allowing information to be transferred between the ink container 18 and the printer portion 12.

Similarly, the printhead 16 includes an information storage device 38 such as an electrical storage device associated therewith. A plurality of electrical contacts 40 are electrically connected to the electrical storage 38 in a manner similar to the electrical storage device 38 associated with the ink container 18. With the printhead 16 properly inserted into the scanning carriage 22 the plurality of electrically contacts 40 engage a corresponding plurality of electrical contacts 42 associated with the printing device 12. Once properly inserted into the scanning carriage, the electrical storage device 38 associated with the printhead 16 is electrically connected to the controller 26 by way of a plurality of electrical conductors 46.

Although electrical storage devices 38 associated with each of the ink containers 18 and the printheads 16 are given the same element number to indicate these devices are similar, the information stored in the electrical storage device 38 associated with the ink container 18 will, in general, be different from the information stored in the electrical storage device 38 associated with the printhead 16. Similarly, the information stored in electrical storage device 38 associated with each ink container of the plurality of ink containers 18 will in general be different and unique to the particular ink container of the plurality of ink containers 18. The particular information stored on each electrical storage device 38 will be discussed in more detail later.

Although the electrical storage devices 38 shown in FIG. 2A is linked to the controller 26 by the electrical contacts 42 and 40 associated with each of the printer portion 12 and the replaceable consumable 14, respectively, other linking devices can also be used. The link between the replaceable printing component 14 and the printer portion 12 can be any suitable link for transferring information between the printing component 14 and printer portion 12. For example, the link can be some form of optical link such as an infrared link or some conventional device.

Figure 3:
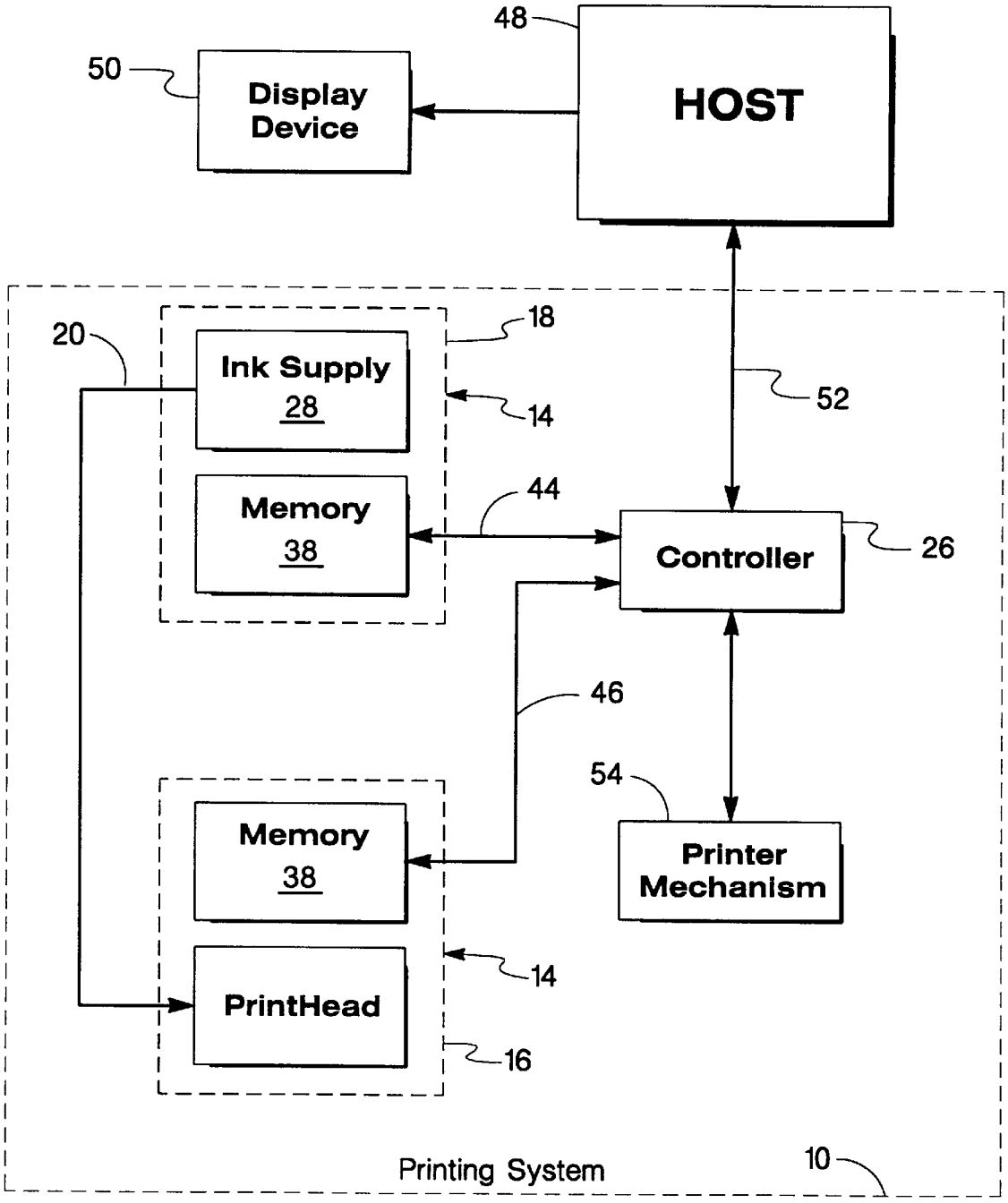
FIG. 3 depicts a schematic block diagram of the ink jet printing system of FIG. 1 shown connected to a host and which includes a removable ink container and printhead each of which contain the electrical storage device.

FIG. 3 represents a block diagram of the printing system 10 of the present invention shown connected to an information source or host computer 48. The host computer 48 is shown connected to a display device 50. The host 48 can be a variety of information sources such as a personal computer, work station, or server to name a few, that provides image information to the controller 26 by way of a data link 52. The data link 52 may be any one of a variety of conventional data links such as an electrical link or an infrared link for transferring information between the host 48 and the printing system 10.

The controller 26 is electrically connected to the electrical storage devices 38 associated with each of the printhead 16 and the ink container 18. In addition, the controller 26 is electrically connected to a printer mechanism 54 for controlling media transport and movement of the carriage 22. The controller 26 makes use of parameters and information provided by the host 48, the memory 38 associated with the ink container 18 and memory 38 associated with the printhead 16 to accomplish printing.

The host computer 48 provides image description information or image data to the printing system 10 for forming images on print media. In addition, the host computer 48 provides various parameters for controlling operation of the printing system 10, which is typically resident in printer control software typically referred to as the "print driver". In order to ensure the printing system 10 provides the highest quality images it is necessary that the operation of the controller 26 compensate for the particular replaceable printer component 14 installed within the printing system 10. It is the electric storage device 38 that is associated with each replaceable printer component 14 that provides parameters particular to the replaceable printer component 14 that allows the controller 26 to utilize these parameters to ensure the reliable operation of the printing system 10 and insure high quality print images.

Among the parameters, for example which can be stored in electrical storage device 38 associated with the replaceable printing component 14 are the following: actual count of ink drops emitted from the printhead 16; a date code associated with the ink container 18; date code of initial insertion of the ink container 18; system coefficients; ink type/color: ink container size; age of the ink; printer model number or identification number; cartridge usage information; just to name a few.

The electrical storage device 38 shown in FIGS. 2A and 2B is a four terminal device. Alternatively, the electrical storage device 38 can have other configurations such as a two terminal device. One such two terminal device includes a power and ground terminals. Clock signals and data signals are provided on the power terminal. An example of such a two terminal memory device is a 1K Bit read/write Electrically Programmable Read Only Memory (EPROM) such as the Dallas Semiconductor part number DS 1982, manufactured by the Dallas Semiconductor Corporation.

Figure 4:
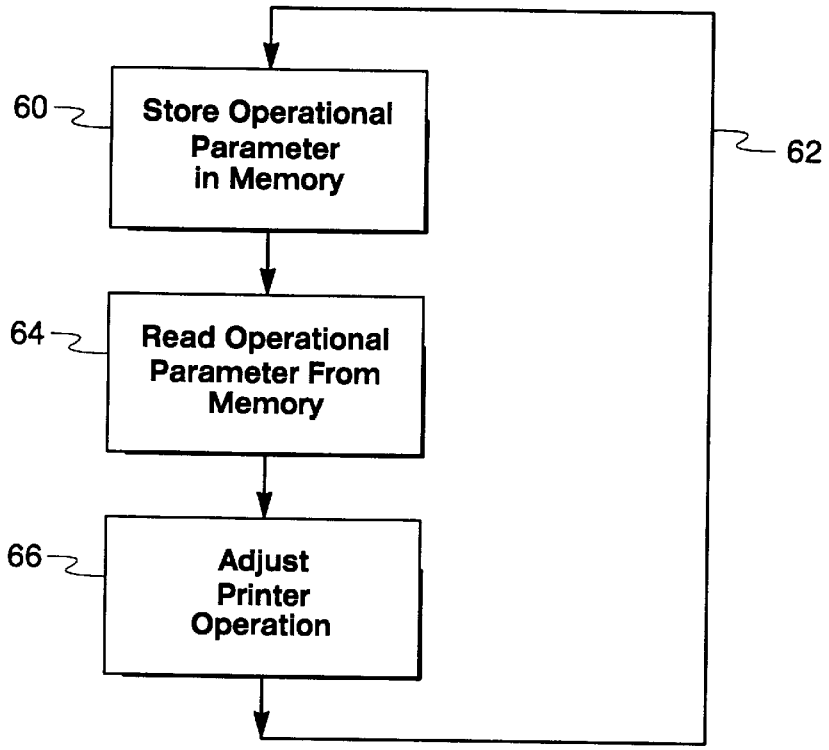
FIG. 4 depicts a simplified representation of a method for storing and retrieving operational parameters from the electrical storage device.

FIG. 4 is a representation of the operation of the printing system whereby operational parameters are stored in the electronic storage device 38 associated with the replaceable printing component 14. As represented by step 60 these operational parameters may be stored in the electrical storage device 38 associated with the replaceable printing component 14. These operational perimeters may be stored at the time of manufacture or prior to insertion into the ink jet printing system 10. Alternatively, these operational parameters may be updated at selective times during the operation of the printing system 10 as represented by path 62.

During operation of the printing system 10 one or more operational parameters are read from the electrical storage device 38 by the controller 26 as represented by step 64. These operational parameters are then used by the controller 26 to adjust printer operation as represented by step 66. In general, operational parameters are used by the printing system to adjust operation of the printer either directly such as using the controller 26 to adjust operation of the printing system 10 based on operational parameters or indirectly such as prompting the user to take some action that effects the operation of the printing system 10. These operational parameters effect various aspects of printer operation such as controlling how ink is deposited on print media. In addition, these operational parameters either enable or disable printer operation for various reasons such as when an out of ink condition is detected or if a non-compatible replaceable printing component 14 is installed.

The operational parameters in the electrical storage device 38 can be updated in the event that the parameter changes during operation of the printing system 10. Operational parameters that tend not to change during operation of the printing system 10 are either stored in the controller 26 after a new replaceable printing component is first installed into the printer portion 12 or retrieved from the replaceable printing component each time operational characteristics of the printer portion 12 is altered.

One example of the use of operational parameters stored in the electrical storage device 38 associated with the replaceable printing component 14 is where ink usage information is maintained on the electrical storage device 38 associated with the ink container 18. As ink stored in the ink container 18 is consumed, the controller 26 updates this ink volume information stored in the electrical storage device 38 so that this parameter reflects current information regarding ink remaining in the ink container 18. By maintaining current ink volume information in the electrical storage device 38 then the ink volume information remains with the ink container 18 even if the ink container is removed and inserted back into the printing system 10 at a later time. By maintaining current operating parameters related to ink volume and storing these parameters on the ink container 18 allows the printing system 10 to prevent or minimize the risk of operating the printhead portion 16 without an adequate supply of ink. If this printhead 16 is operated for a sufficient length of time without ink catastrophic failure of the printhead 16 can result.

Other examples of the use of operational parameters which are stored in an electrical storage device 38 associated with the ink container 18 includes: color map coefficients, ink colorimetry, color code, dry time coefficients, printer driver revision number, freshness date, print mode coefficients, and outgas rate data for ink. Some examples of operational parameters stored in the electrical storage device 38 associated with the printhead 16 include drop volume parameters, firing energy parameters, printhead alignment parameters, and driver version number.

Figure 5:
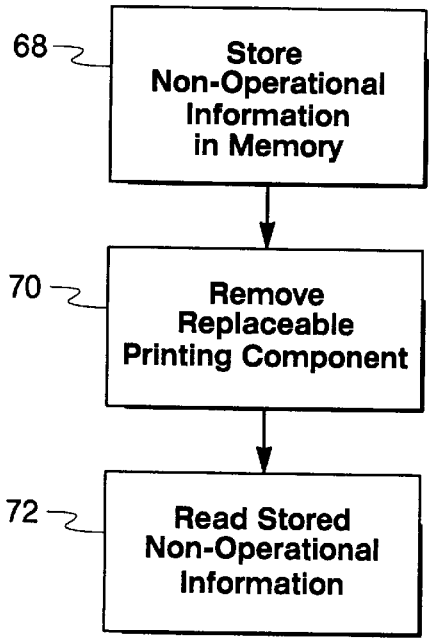
FIG. 5 depicts a simplified representation of a method of the present invention for storing and retrieving non-operational parameters from the electrical storage device.

FIG. 5 depicts a representation of printing system 10 operation whereby non-operational information is stored in the electrical storage device 38 associated with replaceable printing components 14. It is the use of parameters stored on the replaceable printing component 14 that are not used in normal operation of the printing system 10 that is the subject of the present invention. These non-operational parameters are not used either directly or indirectly by the printer to adjust, enable or disable printer operation in contrast to the parameters represented in step 66 of FIG. 4. Instead, these non-operational parameters are stored in the electrical storage device 38 as represented by step 68. This information may be stored in the electrical storage device 38 at the time of manufacturing or after the replaceable printing component 14 is installed in the printing system 10. The replaceable printing component 14 is then removed from the printing system 10 as represented by step 70 and the non-operational information stored on the electrical device 38 is extracted as represented by step 72.

These non-operational parameters include printing system parameters that are indicative of a current state or usage history of one or more parts of the printing system 10. The collection of this non-operational data allows one to infer various aspects regarding the frequency and type of printing accomplished with the printing system 10. This information is useful to better understand how the printing system 10 is being used so that the marketing of the printing system 10 can be improved. This information is also useful to improve the design of the printing system 10. Once it is understood how the printing system 10 is being used the system can be improved to better perform this type of printing. Finally, this information is useful for diagnosing printing system failures such as end of life failures. This non-operational information can be used to determine usage history that can be used to infer one or more printing components has failed.

Specific examples of non-operational information or parameters will now be discussed in more detail. These examples are intended for illustrative purposes and is not intended to be an exhaustive listing of non-operational parameters. These non-operational parameters include failure codes, product identifiers, power on time, page count, installation date, last usage date and insertion count.

Failure code parameters is information relating to failures within the printing system 10. This failure information is retained for diagnostic purposes such as for servicing the printing system 10. Additionally, this failure information is useful for identifying areas of lower reliability in the printing system so that the printing system can be improved.

Product identification information indicates the particular printer portion 12 in which the replaceable printing component 14 was installed. For the case where the replaceable printing component is the printhead 16, this product identification information can be used to determine if a particular printer portion 12 is inducing more failures in the printhead 16 than other printer portions compatible with the printhead 16. Collection of this data aids in the improvement in reliability of the printing system 10. Further a combination of product identification number and failure code data allows incidence rates of particular failure types to be tracked for each particular printer portion 12. For the case where the replaceable printing component is the ink container 18 the use of product identification information is useful for determining how much printing is being done and how much ink is being consumed per day for the particular printer portion 12. To determine this information additional information such as date installed, date last used, and pages printed for the ink container 12 as will be discussed later, is required.

Power-on time information is indicative of the time that the power is on while the replaceable printing component 14 is present in the printer portion 12. This power-on time information provides a basis for estimating how long power has been applied before a failure of the replaceable printing component 14. This information is useful for estimating an aspect of printhead life for reliability tracking.

Page count information is indicative of number of pages printed during the time the particular replaceable printing component 14 such as ink container 18 is resident in the printer portion 12. For example an ink container 18 having yellow ink therein will count the number of pages printed even if these pages are printed with non-yellow ink. Therefore, the page count will be larger if the printing system 10 is used to print primarily non-yellow images than if the printer is used for printing full density color graphics with high use of yellow. From this page count information one can infer how the printing system 10 is being used. The use of the printing system 10 provides useful information for both marketing and troubleshooting purposes. This page count information is useful for marketing, design, and troubleshooting purposes.

Installation and last use date information is indicative of the date the replaceable printing component 14 was first installed and last used in the printing system 10. This information is used to infer how long the replaceable printing component 14 was installed in the printing system 10. In addition, this information in conjunction with number of pages printed is used to estimate number of pages per day or ink volume per day a particular printing system 10 prints or uses, respectively. This estimate of ink usage is used to adjust the volume of cartridges manufactured to better match demand.

Insertion count information is indicative of the number of times the replaceable printing component is removed and reinserted into the printer portion 12. This information provides data regarding how printers are being used which is helpful in troubleshooting if there are problems and also helps set design goals such as number of insertions for new printer designs.

In one preferred embodiment, the replaceable printing component 14 is inserted into a reading device that reads this non-operational information from the electrical storage device 38 associated with the replaceable printing component 14. This information is then used to collect various kinds of statistical data such as marketing data. Alternatively, a suitable port may be provided on the printing system 10 so that this non-operational information within the electrical storage device 38 can be passed to a suitable information collection device such as a computer or microprocessor based information collection device. For example, the printing system 10 may be connected to a network either directly or indirectly such as the internet. This non-operational information can be passed to a remote collection site on the network. Alternatively, a link such as a modem or radio frequency (RF) link or optical link may be used to pass this non-operational information from the printing system 10 to a suitable collection device.

The non-operational parameters can be stored on the electrical storage device 38 associated with the particular replaceable printing component 14, stored on an electrical storage device 38 associated with more than one replaceable printing component 14 or stored on a memory device 38 associated with the printer portion 12. For example, storing non-operational parameters associated with all of the ink containers 18 on the electrical storage device 38 associated with one of the ink containers 18 such as the black ink container then only one ink container 18, the black ink container, needs be collected to collect all of the non-operational parameters related to all of the ink containers 18.

Other types of non-operational information that may be stored on the electrical storage device 38 include information for identifying images printed. For example, credits can be extended to an end user for printing certain types of images such as advertisements. In this example, the advertiser can then be billed once this information is read from the electronic storage device 38. The printing system 10 can then be enhanced or improved to be more optimized for selected types of printing to better serve the customer.

Another type of non-operational information that is stored on the electrical storage device 38 includes information related to servicing or maintenance of the printing system 10. This information can provide a complete history of printing system usage that may be helpful for determining printer problems in the event of a printer failure. This servicing information may include failure codes indicating particular failure types. Other information relating to servicing may include first insertion date for the replaceable printing component, usage time, last usage date, or various other parameters that could be useful for determining a particular mode in the event of a failure.

Still other types of non-operational information may include information relating to the types of images printed such as number of pages printed and the percentages of each color used on each of these documents. By collecting this information one can better understand how the printing system 10 is used by customers.

What is claimed is:

1. A replaceable printer component for use in an ink jet printing system, the ink jet printing system having a control portion for controlling operation of the printing system, the replaceable printer component including:

a linking portion connectable to the control portion for transferring information between the replaceable printer component and ink jet printing system; and a storage device coupled to the linking portion, the storage device configured to interact with the control portion to receive information from the control portion, wherein the information the storage device receives from the control portion is not directly related to the operation of the printing system.

2. The replaceable printer component of claim 1 wherein the information the storage device receives from the control portion is information used in marketing the printing system.

3. The replaceable printer component of claim 1 wherein the information the storage device receives from the control portion is information used in maintenance of the printing system.

4. The replaceable printer component of claim 1, wherein the information the storage device receives from the control portion includes information directed to printer components used in the printing system.

5. The replaceable printer component of claim 1 wherein the replaceable component is an ink container for supplying ink to the ink jet printing system.

6. The replaceable printer component of claim 1 wherein the replaceable component is a printhead for selectively depositing printing fluid in response to control signals.

7. The replaceable printer component of claim 1 wherein the linking portion is an electrical connection for electrically connecting the replaceable printing component with the control portion of the printing system.

8. The replaceable printer component of claim 1 wherein the storage device receives product identification information specifying a particular printer portion within the printing system.

9. The replaceable printer component of claim 1 wherein the storage device receives page count information specifying number of pages printed.

10. The replaceable printer component of claim 1 wherein the storage device receives installation date information for the replaceable printer component.

11. The replaceable printer component of claim 1 wherein the storage device receives count information indicative of the number of times the the replaceable printer component has been removed from and reinserted into the printing system.

12. An ink jet printing system, the ink jet printing system including:

a replaceable printing component for use in the printing system, the replaceable printing component including a memory portion for storing information that does not relate directly to normal operation of the printing system; and a control portion for providing the information to the memory portion of the replaceable printing component.

13. The ink jet printing system of claim 12 wherein the information the memory portion receives from the control portion is information used in marketing the printing system.

14. The ink jet printing of claim 12 wherein the information the memory portion receives from the control portion is information used in maintenance of the printing system.

15. The ink jet printing system of claim 12 wherein the replaceable printing component is an ink container for supplying ink to the ink jet printing system.

16. The ink jet printing system of claim 12 wherein the replaceable printing component is a printhead for selectively depositing printing fluid in response to control signals.

17. The ink jet printing system of claim 12 further including a further replaceable printing component, the further printing component providing parameter information to the control portion, wherein the control portion provides the parameter information of the further printing component to the memory portion of the replaceable printing component for storage of the parameter information in the memory portion.

18. A method for collecting data from an ink jet printing system, the method including:

transferring information from the printing system to a memory portion associated with a replaceable printing component; and removing the replaceable printing component from the printing system and reading information in the memory portion transferred from the printing system.

19. The method of claim 18 wherein transferring information from the printing system includes transferring information that is not directed to normal operation of the printing system.

20. The method of claim 18 wherein reading information in the memory portion transferred from the printing system is performed by a memory reading device different from the printing system.

21. The method of claim 18 wherein transferring information from the printing system includes transferring information relating to a second replaceable printing component to the memory portion associated with the replaceable printing component.

22. An ink jet printing system for depositing ink on print media, the ink jet printing system having a control portion for controlling operation of the printing system, the ink jet printing system including:

a first replaceable printer component having a first information storage device, the first information storage device containing information stored therein;

a second replaceable printer component having a second information storage device, the second information storage device containing information stored therein;

wherein the control portion retrieves information from the first information storage device of the first replaceable printing component and stores the information from the first replaceable printer component in the second information storage device; and wherein the second information storage device contains printer usage information that is not directly related to the operation of the printing system.

* * * * *